United States Patent [19]

Johnson

[11] 4,265,059

[45] May 5, 1981

[54] KIOSK

[75] Inventor: David J. Johnson, Muskegon, Mich.

[73] Assignee: Studio One Services, Inc., Muskegon, Mich.

[21] Appl. No.: 969,922

[22] Filed: Dec. 15, 1978

[51] Int. Cl.[3] ..... E04B 1/346

[52] U.S. Cl. ..... 52/66; 52/73; 52/82; D25/16

[58] Field of Search ..... 52/66, 65, 73, 82, 72, 52/67, 79–84; D25/16

[56] References Cited

U.S. PATENT DOCUMENTS

| | | | |
|---|---|---|---|
| D. 75,233 | 5/1928 | Geisenberger et al. | 225/16 X |
| D. 189,416 | 12/1960 | Lindgren | D25/16 X |
| D. 245,866 | 9/1977 | Schuldenfrei et al. | D25/16 X |
| D. 251,068 | 2/1979 | Mills | D25/16 X |
| 2,563,886 | 8/1951 | Taylor | 52/66 X |
| 2,792,794 | 5/1957 | Miller | 52/66 X |
| 3,345,786 | 10/1967 | Buzzella et al. | 52/82 X |
| 3,543,454 | 12/1970 | Danin | 52/79.4 X |
| 4,174,594 | 11/1979 | Panzini | 52/66 X |

*Primary Examiner*—Carl D. Friedman

*Attorney, Agent, or Firm*—Nathaniel A. Humphries

[57] ABSTRACT

A kiosk has a central base enclosing an electric motor drivingly connected to an umbrella-like cover supported over the central base for upward and downward movement. A closed counter encloses the central base with a walk space between the counter and the central base and a door in the counter permitting entry to the walk space. The umbrella-like cover is movable by the motor to an elevated position in which the kiosk can be used and a lower position in which it lies over and partially encloses the counter and prevents opening of the door in the counter. A key switch on the outer surface of the counter permits raising of the umbrella-like cover and lowering of the cover as required by the user.

6 Claims, 7 Drawing Figures

KIOSK

This invention is in the field of counter-type merchandise or service rendering facilities and is more particularly directed to a kiosk construction which can be secured against unauthorized entry during periods of non-use.

A highly visible and effective merchandising or vending of services or goods can be provided in public areas in facilities such as shopping malls and the like by the use of small stands or kiosks positioned in public areas or passageways in which there is substantial pedestrian traffic. Unfortunately, prior known devices of this type have not proven to be entirely satisfactory in that they are difficult to secure against unauthorized entry during periods of non-use. Such devices do not have the structural strength of a permanent portion of a building and must consequently be capable of being moved to a secure area or must be provided with closures such as shutters or the like in order to provide for merchandise or other items contained within the enclosure. For example, counters can be locked by the user; however, employees frequently forget to do so. Moreover, a locked counter is easily broken open and consequently provides only scant protection. Another alternative is to make such devices portable so that they can be removed to a secure area when required; however, this expedient is frequently inconvenient and is usable only for small installations. Thus, the prior art approaches have not proven to be entirely satisfactory in that they are inconvenient and expensive to use and construct while also failing to provide desirable functions on many cases.

Therefore, it is the primary object of this invention to provide a new and improved merchandising or vending system.

Another object of this invention is the provision of a new and improved vending system in which an area within the system is capable of being easily secured during periods of non-use.

Yet another object of this invention is the provision of a new and improved kiosk having the capability of being securely closed in an easy manner.

Achievement of the foregoing objects is enabled by the preferred embodiment which comprises a kiosk consisting of a generally circular or closed loop counter above which an umbrella-like roof or cover is supported in an elevated position during periods of operation of the system. The umbrella-like roof is supported by a telescopic central column which includes a support tube vertically moved by electrical drive means capable of lifting the umbrella-like roof to its elevated position spaced above the counter and which is also capable of lowering the umbrella-like roof to a lower position in which it rests upon or immediately adjacent the counter top. When the umbrella-like roof is in its lower position, the entire area within the confines of the counter is secure from unauthorized entry. However, proper entry is permitted by virtue of an electric switch or other means connected to the drive motor for lifting the umbrella-like roof member. A swing out door section in the counter permits ingress to the area inside the counter when the umbrella-like roof or cover is in its elevated position.

A better understanding of the manner in which the foregoing objects are achieved will be enabled when the following detailed description is considered in conjunction with the appended drawings, in which.

Figure 1:
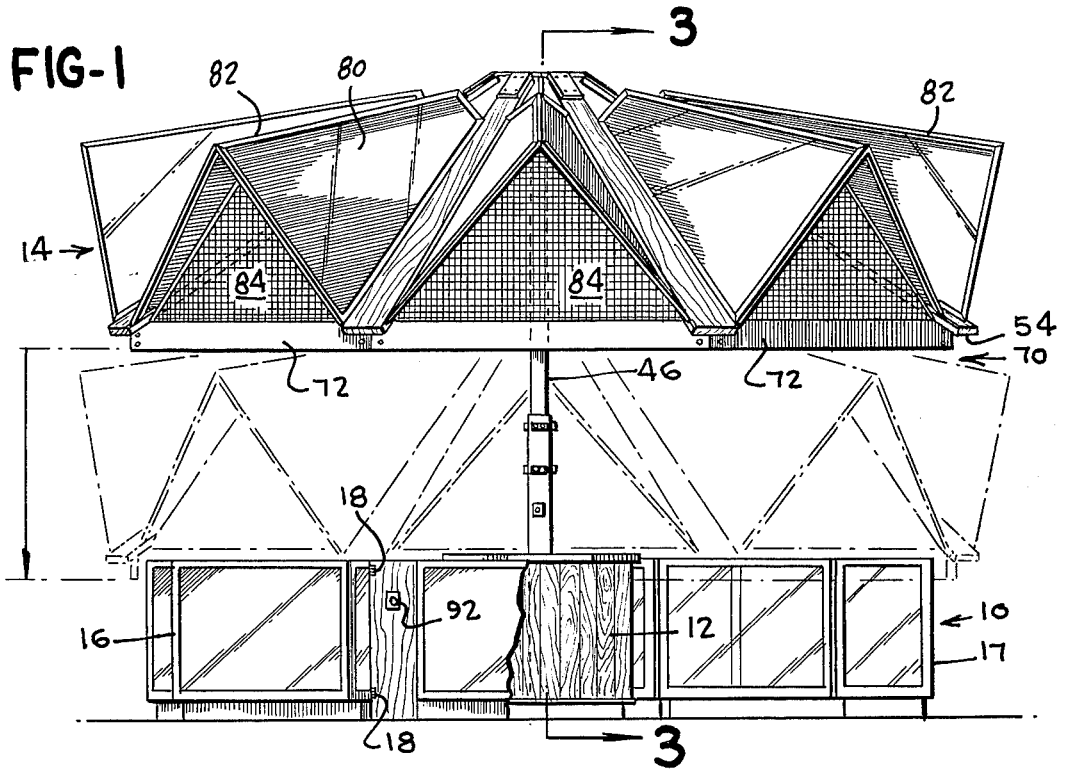
FIG. 1 is a side elevation view of the preferred embodiment of the invention illustrating the umbrella-like top in an elevated position in solid lines and in a lower position in phantom lines.

The primary elements of the preferred embodiment comprise a closed multi-section counter 10 encircling a central housing 12 which encloses supporting and drive means for an umbrella-like cover 14. A door section 16 in the counter is hingedly movable at 18 to an outer phantom line position shown in FIG. 2 to permit ingress and egress to the area between the counter and the central housing 12 when the umbrella-like roof or cover 14 is in its elevation position of FIG. 1.

Central housing 12 includes a base plate 20 supported on box channel frame sections 22. An electric motor 24 is supported on the base plate 20 and is drivingly connected to a step-down transmission 26 which has an output shaft 30. A drive coupling 32 provides a driving connection between the output shaft 30 and a gear shaft 34 on which a bevel drive gear 36 is keyed. Bevel drive gear 36 meshes with an elevator screw gear 38 which is keyed to the lower end of a rotary elevator screw 40 enclosed in a protective cover shield 41 and having external threads 42 meshing with the internal threads of a lift nut 44. The lift nut 44 is fixedly connected to a vertically oriented axially movable support tube 46 which is of square cross-sectional configuration.

Support tube 46 is mounted for axial movement within the confines of a fixedly positioned hollow tubular vertical guide housing 48 supported by the base plate 20 and rigidly held in a vertical orientation by brace means in the central housing 12. Additionally, the vertical guide housing 48 includes a bearing support fitting 50 which supports the elevator screw 40 for rotation about its axis. The upper end of the support tube 46 supports and is connected to the umbrella-like cover 14 in a manner to be discussed. Teflon bearing elements 49 adjustably engage the side of support tube 46 and are held in position by threaded plugs 51 in support blocks 53.

The umbrella-like cover 14 is formed of a central cap plate 50 welded to the upper end of the support tube 46 and braced with respect to the lift tube by a plurality of brace plates 52 and 53 fitted over the upper end of the support tube 46 to which further connection is provided by elongated nut and bolt assemblies 55. A plurality of wooden radial ribs 54 are attached to the cap plate 50 by support bracket plates 56 bolted to the cap plate by nut and bolt assemblies 58. Bracket plates 56 are similarly bolted to the wooden ribs 54 by nut and bolt assemblies 60 extending through the radial ribs 54 and through a holding plate 62 on the opposite, or lower, side of each of the wooden ribs.

It will be observed that the ribs 54 extend downwardly from their upper centrally located supported ends connected to the support bracket plates 56 with the lower ends of the ribs being connected to a base ring frame 70 formed of a plurality of connected linear chordal segments 72 which are connected by connectors 73 and are dimensioned so that the radial ribs 54 are held in compression between the base ring frame 70 and the support bracket plates 56 to provide substantial structural rigidity and integrity to the umbrella-like cover member. Additionally, the umbrella-like cover member 14 includes first and second cooperating quadrilateral shaped roof panels 80 positioned between the adjacent ribs. The roof panels 80 between two adjacent ribs have trim edges such as aluminum extrusions 81 intersect at an apex 82 with a triangular end panel 84 being provided beneath and between each of the cooperating adjacent roof panels. It should be understood that the roof panels and end panels can be of any conventional plastic, fiberglass, metal or the like construction dependent upon the desired ornamental and functional effect.

The closed counter 10 is formed of the fixedly positioned counter sections 17 and the movable counter door section 16 which is hinged at 18 to the fixed sections 17, as was previously noted. Door section 16 can swing outwardly to the phantom line position of FIG. 2 to permit ingress and egress to the area within the confines of the counter at such times as when the umbrella-like top is in its elevated position of FIG. 1.

A key operated switch 92 is provided on the exterior surface of the counter 10 and is effective for operating the motor 24 in either direction of rotation through a conventional power supply circuit. The motor is operated in one direction to rotate the elevator screw 40 for lifting the umbrella-like cover 14 or in an opposite direction for lowering the cover. A rotary limit switch housing 100 encloses rotary limit switches which are actuated by means in the housing driven through a shaft connector 110 connected to the gear shaft 34 for limiting the extent of upward movement of the support tube 46 after shaft 34 is rotated a desired number of revolutions and for similarly stopping the downward movement of the support tube 46. It will be observed that rotation of shaft 34 by motor 24 effects the rotation of gear 36, gear 38 and the elevator screw 40 to consequently effect upward or downward movement of the umbrella-like cover 14 by virtue of axial reciprocation of the support tube 46.

Figure 2:
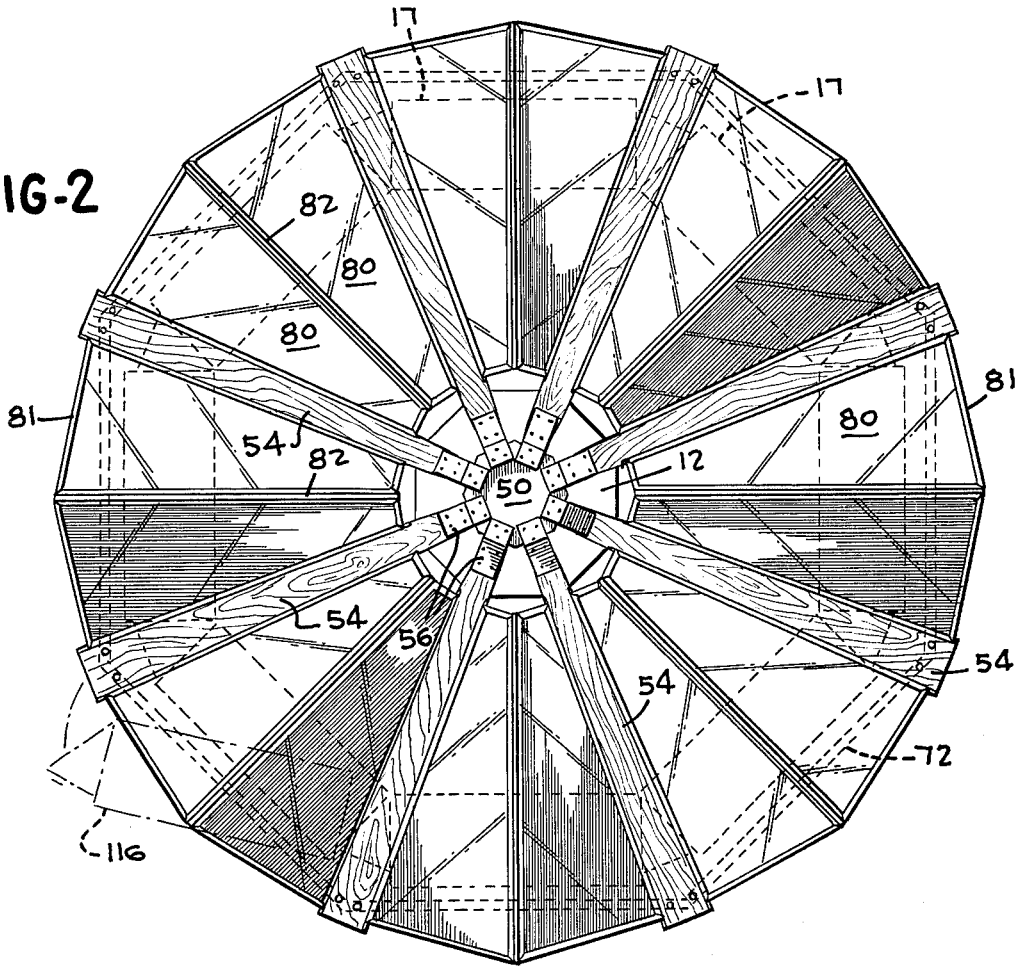
FIG. 2 is a top plan view.
Figure 3:
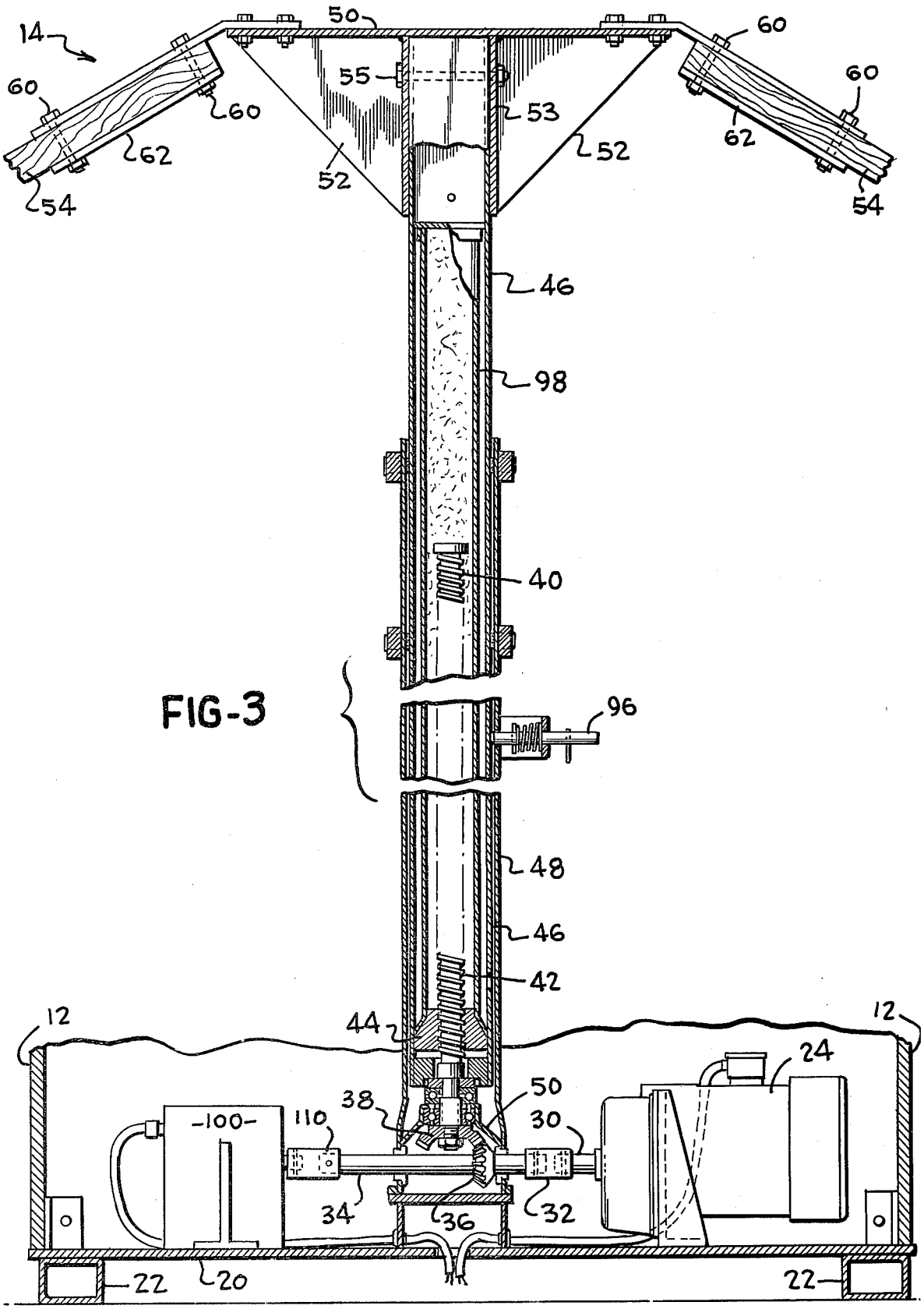
FIG. 3 is a sectional view taken along lines 3—3 of FIG. 1 illustrating the umbrella-like top in its lowered position.
Figure 4:
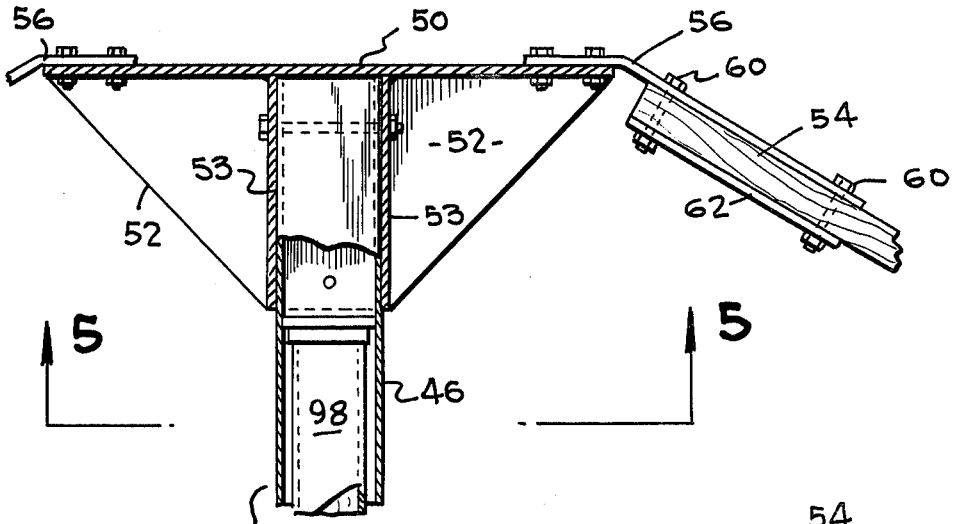
FIG. 4 is a view similar to FIG. 3 but illustrating the umbrella-like top in its elevated or raised position.
Figure 5:
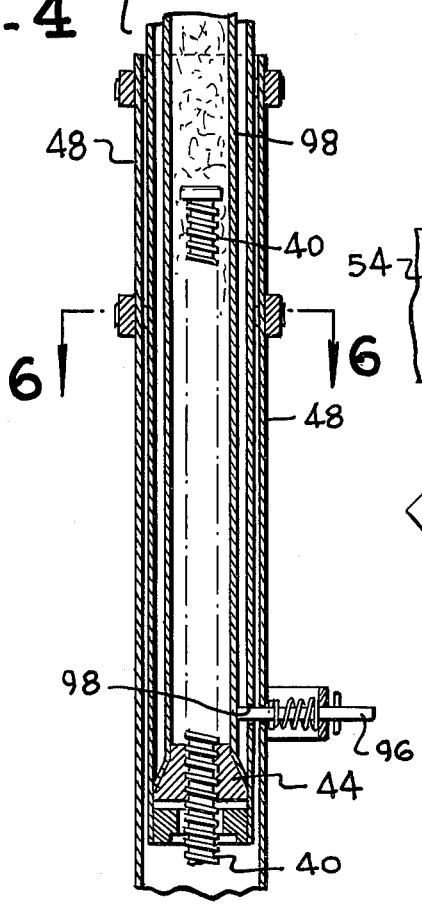
FIG. 5 is a sectional view taken along lines 5—5 of FIG. 4.
Figure 5:
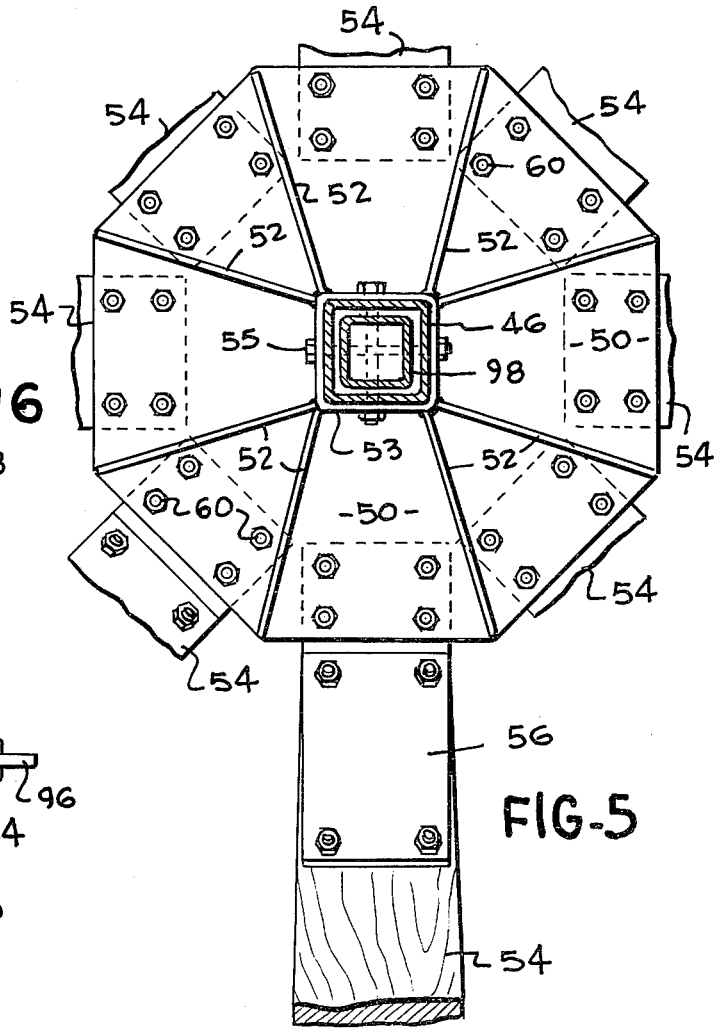
Figure 6:
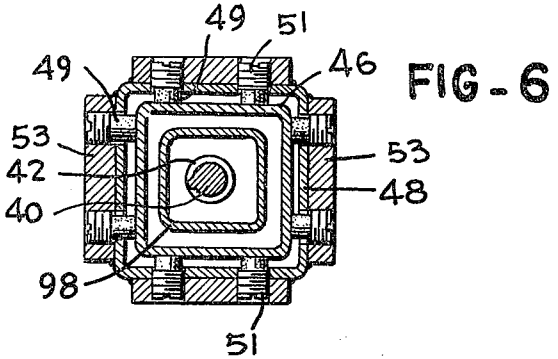
FIG. 6 is a sectional view taken along lines 6—6 of FIG. 4.
Figure 7:
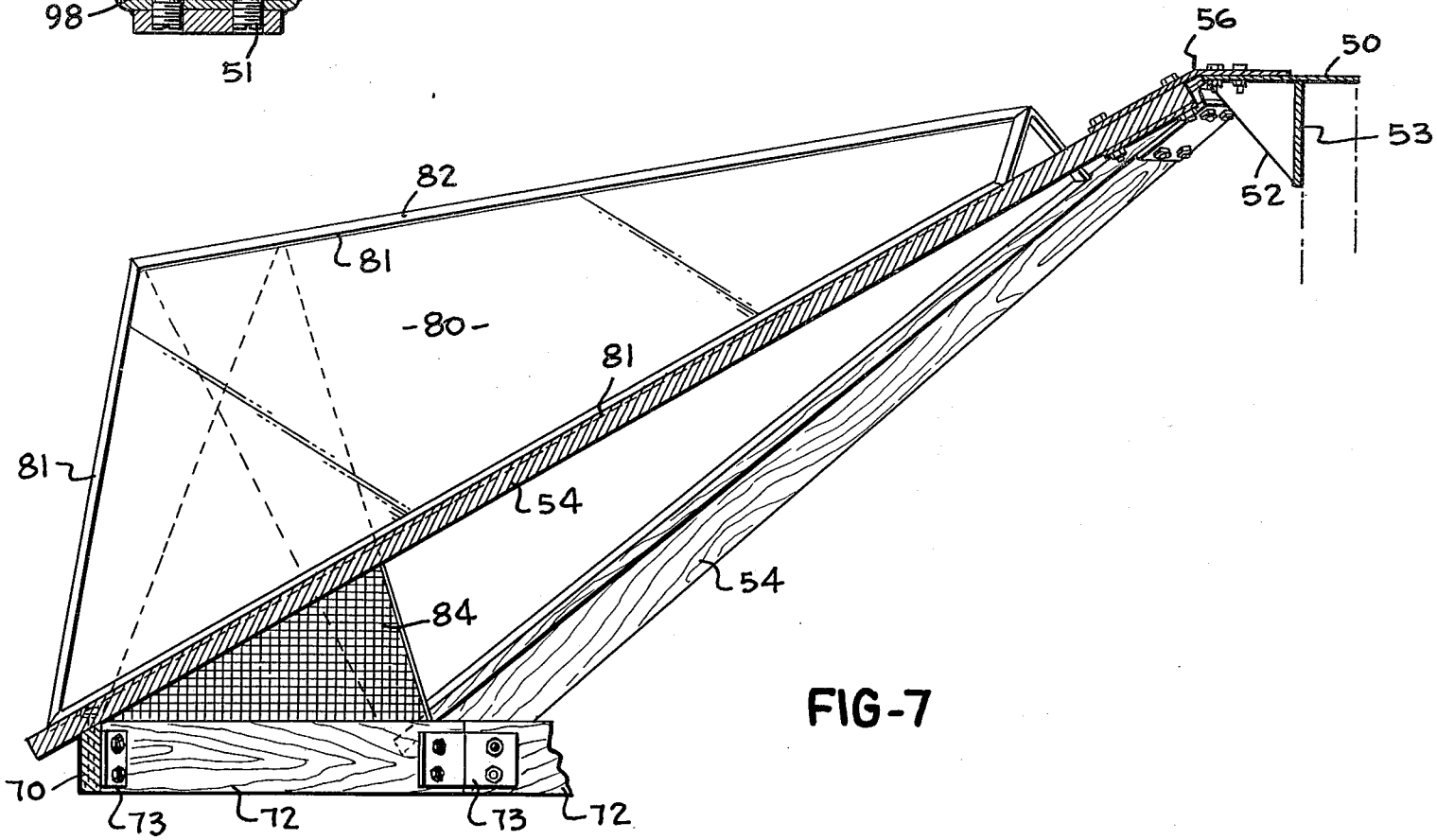
FIG. 7 is a sectional view taken along lines 7—7 of FIG. 1.

When the umbrella-likecover is in its lower phantom line position illustrated in FIG. 1, it completely encloses the space within the confines of the counter and rests upon or is clearly adjacent the upper surface of the counter to provide a secure enclosing thereof since ring 70 extends below, and prevents opening of, the door section 16. The only way in which the umbrella-like cover can be moved to its upper solid line position of FIG. 1 is by operation of the key operated switch 92. A lock pin 96 is movable into an opening 98 in support tube 46 to insure retention of the umbrella-like cover 14 in its elevated position. It should also be observed that the base ring frame 70 prevents opening movement of the counter door section 16 when the umbrella-like cover is in its lower phantom line position of FIG. 1.

Numerous modifications of the preferred embodiment will undoubtedly occur to those of skill in the art. For example, different mechanical, hydraulic or electric means can be employed for lifting or lowering the umbrella-like cover or top 14 and the exact configuration and shape of the cover and counter can vary considerably without departing from the spirit and scope of the invention which is to be limited solely by the appended claims.

I claim:

1. A kiosk comprising:

a central housing having a hollow interior;

a vertically extending movable support tube having a lower end mounted and supported in said central housing;

an umbrella-like cover mounted on the upper end of said movable support tube;

counter means spaced from and encircling said central housing to define a space therebetween and having an outer periphery in vertical alignment with the outer periphery of said umbrella-like cover;

motor driven power drive means mounted in said said central housing for moving said support tube between a lower position in which the umbrella-like cover is adjacent the upper extent of said counter means so as to result in secure enclosure of the space within the confines of said counter means and an upper position in which the umbrella-like cover is at a sufficient elevation above the counter to permit unimpeded human occupancy of the space between the counter means and the central base means; and wherein said umbrella like cover includes:

a cap plate assembly attached to the upper end of said support tube;

a base ring frame positioned in a horizontal plane concentric with respect to the vertical axis of the support tube at an elevation below the cap plate assembly; and a plurality of radial ribs equidistantly positioned about the support tube with each radial rib having an upper end connected to the cap plate assembly and a lower end extremity connected to the base ring frame with said radial ribs being held in compression by the static interaction of the radial ribs with the top plate assembly and the base ring frame.

2. A kiosk comprising:

a central housing having a hollow interior;

a vertically extending movable support tube having a lower end mounted and supported in said central housing;

an umbrella-like cover mounted on the upper end of said movable support tube;

counter means spaced from and encircling said central housing to define a space therebetween and having an outer periphery in vertical alignment with the outer periphery of said umbrella-like cover;

motor driven power drive means mounted in said central housing for moving said support tube between a lower position in which the umbrella-like cover is adjacent the upper extent of said counter means so as to result in secure enclosure of the space within the confines of said counter means and an upper position in which the umbrella-like cover is at a sufficient elevation above the counter to permit unimpeded human occupancy of the space between the counter means and the central base means and wherein said umbrella-like cover includes:

a cap plate assembly attached to the upper end of said support tube;

a horizontal base ring frame concentric with respect to the vertical axis of the support tube positioned at an elevation below the top plate assembly;

a plurality of radial wooden ribs equidistantly positioned about the support tube;

bracket means connecting the upper end of each wooden rib to the cap plate assembly and means connecting the base ring frame with the lower end of said radial wooden ribs to hold the ribs in compression by the static interaction of the ribs with the bracket means.

3. The invention of claim 2 wherein said counter means includes a pivotal door section which can be pivoted outwardly about a vertical axis for permitting entry of a user to said wall space within the confines of the counter means.

4. The invention of claim 2 wherein said power drive means includes electric motor means and a power circuit for said electric motor means including a key operated switch mounted in a position accessible externally of said counter means; and wherein said base ring extends down over said door section to prevent opening thereof.

5. A kiosk comprising:

a central housing having a hollow interior;

a vertically extending movable support tube having a lower end mounted and supported in said central housing;

an umbrella-like cover mounted on the upper end of said movable support tube;

counter means spaced from and encircling said central housing to define a space therebetween and having an outer periphery in vertical alignment with the outer periphery of said umbrella-like cover;

wherein said umbrella-like cover includes:

a cap plate assembly attached to the upper end of said support tube;

a horizontal base ring frame concentric with respect to the vertical axis of the support tube positioned at an elevation below the top plate assembly;

a plurality of radial downwardly canted ribs equidistantly positioned about the support tube;

bracket means connecting the upper end of each of said downwardly canted ribs to the cap plate assembly and means connecting the base ring frame with the lower ends of said radial ribs to hold the ribs in compression by the static interaction of the ribs with the bracket means;

wherein said power drive means includes electric motor means drivingly connected to a threaded elevator screw threadably engaged with a lift nut on said support tube and a power circuit for said electric motor means including a key operated switch mounted in a position accessible externally of said counter means; and wherein said counter means includes a pivotal door section which can be pivoted outwardly about a vertical axis for permitting entry of a user to said walk space within the confines of the counter means and said base ring extends down over said door section to prevent opening thereof.

6. A kiosk comprising:

a central housing having a hollow interior;

a vertically extending movable support tube having a lower end mounted and supported in said central housing;

an umbrella-like cover mounted on the upper end of said movable support tube;

counter means spaced from and encircling said central housing to define a space therebetween and having an outer periphery in vertical alignment with the outer periphery of said umbrella like cover;

motor driven power means mounted in said central housing for moving said support tube between a lower position in which the umbrella-like cover is adjacent the upper extent of said counter means so as to result in secure enclosure of the space within the confines of said counter means and an upper position in which the umbrella-like cover is at a sufficient elevation above the counter to permit unimpeded human occupancy of the space between the counter means and the central base means; and wherein said umbrella-like cover includes:

a base ring frame concentric with respect to the vertical axis of the support tube positioned at an elevation below the top plate assembly;

a plurality of canted radial ribs equidistantly positioned about the support tube;

bracket means connecting the upper end of each of said canted radial ribs to the cap plate assembly and means connecting the base ring frame with the lower ends of said canted radial ribs to hold the ribs in compression by the static interaction of the ribs with the bracket means; and first and second roof panels intersecting at an apex extending between and enclosing the space between said adjacent ones of said canted radial ribs; and wherein said counter means includes a pivotal door section which can be pivoted outwardly about a vertical axis for permitting entry of a user to said walk space within the confines of the counter means and said base ring extends down over said door section to prevent opening thereof.

* * * * *